US006188177B1

(12) United States Patent
Adamson et al.

(10) Patent No.: US 6,188,177 B1
(45) Date of Patent: Feb. 13, 2001

(54) LIGHT SENSING DIMMING CONTROL SYSTEM FOR GAS DISCHARGE LAMPS

(75) Inventors: Hugh Patrick Adamson, Boulder; George O. Langer, Lafayette, both of CO (US)

(73) Assignee: Power Circuit Innovations, Inc., Boulder, CO (US)

( * ) Notice: Under 35 U.S.C. 154(b), the term of this patent shall be extended for 0 days.

(21) Appl. No.: 09/315,395

(22) Filed: May 20, 1999

Related U.S. Application Data

(60) Provisional application No. 60/086,096, filed on May 20, 1998.

(51) Int. Cl.[7] ..... H05B 37/02
(52) U.S. Cl. ..... 315/149; 315/158
(58) Field of Search ..... 315/151, 129, 315/149, 307, 293, 226, 158, 156, 150

(56) References Cited

U.S. PATENT DOCUMENTS

| | | | | |
|---|---|---|---|---|
| 3,919,595 | | 11/1975 | Willis, Jr. . | |
| 4,100,476 | | 7/1978 | Ghiringhelli . | |
| 4,684,850 | | 8/1987 | Stevens . | |
| 4,717,863 | * | 1/1988 | Zeiler | 315/307 |
| 4,874,989 | * | 10/1989 | Nilssen | 315/151 |
| 4,888,527 | | 12/1989 | Lindberg . | |
| 4,916,362 | | 4/1990 | Orenstein . | |
| 5,030,887 | * | 7/1991 | Guisinger | 315/158 |
| 5,047,696 | | 9/1991 | Nilssen . | |
| 5,117,161 | * | 5/1992 | Avrahami | 315/226 |
| 5,177,409 | * | 1/1993 | Nilssen | 315/293 |
| 5,192,896 | | 3/1993 | Qin . | |
| 5,381,077 | | 1/1995 | McGuire . | |
| 5,404,080 | * | 4/1995 | Quazi | 315/151 |
| 5,438,239 | * | 8/1995 | Nilssen | 315/151 |
| 5,446,342 | * | 8/1995 | Nilssen | 315/129 |
| 5,519,289 | | 5/1996 | Katyl et al. . | |
| 5,581,158 | * | 12/1996 | Quazi | 315/149 |
| 5,648,702 | | 7/1997 | Nak-choon et al. . | |
| 5,744,913 | * | 4/1998 | Martich et al. | 315/158 |
| 5,850,127 | | 12/1998 | Zhu et al. . | |

FOREIGN PATENT DOCUMENTS

| | | |
|---|---|---|
| 1240556 | 12/1968 | (GB) . |

* cited by examiner

*Primary Examiner*—Don Wong
*Assistant Examiner*—Chuc Tran
(74) *Attorney, Agent, or Firm*—Merchant & Gould PC

(57) ABSTRACT

A control system for controlling the illumination intensity of a gas discharge lamp to provide only necessary illumination and thus conserve power consumption. The control system has a daylight harvester which produces a control signal related to the available light within a given area. The control signal is conducted to a voltage controlled oscillator which, in turn conducts an oscillating signal to a frequency controlled ballast transformer that effectively drives the gas discharge lamp controlling the illumination intensity and energy consumption. The control system alternatively comprises a remote signal receiver for use alone or in addition to the daylight harvester. The control system with a remote signal receiver is controllable using a remote signal generator such as laser pointer. The remote signal receiver allows the user to control the illumination intensity of a gas discharge lamp from the area being illuminated.

22 Claims, 6 Drawing Sheets

LIGHT SENSING DIMMING CONTROL SYSTEM FOR GAS DISCHARGE LAMPS

The present application claims the benefit of U.S. Provisional Application No. 60/086,096 entitled "LOOSELY COUPLED TRANSFORMER CONTROL APPARATUS", filed May 20, 1998.

CROSS REFERENCE TO RELATED APPLICATIONS

The present application is related to U.S. patent application Ser. No. 08/982,975, filed Dec. 2, 1997, titled "Frequency Controlled, Quick and Soft Start Gas Discharge Lamp Ballast and Method Therefor" and U.S. patent application Ser. No. 08/982,974, filed Dec. 2, 1997, titled "Frequency Controller with Loosely Coupled Transformer Having A Shunt With A Gap And Method Therefor."

FIELD OF THE INVENTION

The present invention relates to control systems that control the delivery of current to electrical loads. More particularly, the present invention relates to control systems that control the amount of electrical current delivered to gas discharge lamps to effectively control the illumination of the lamps. Even more particularly, the present invention relates to a control system that incorporates a loosely coupled transformer to control the delivery of current to the lamp.

BACKGROUND OF THE INVENTION

Gas discharge lamps are widely used to illuminate relatively large areas and are actually preferred over incandescent lights in many situations for various reasons. Gas discharge lamps provide the benefit of providing equal or better illumination intensity using relatively less energy than the alternative incandescent lights. These energy efficient lamps are highly beneficial in geographic locations having a reduced power supply and in areas where cost benefits are realized by reducing energy consumption.

Although gas discharge lamps are generally more energy efficient than incandescent lamps, in large scale uses the lamps still consume significant amounts of power. Additionally, in many cases the illumination intensity generated by the lamps is actually more than necessary for a given situation. For example, in a large warehouse environments having skylights and other windows, natural daylight may actually provide most of the necessary illumination such that the gas discharge lamps actually produce supplemental and possibly unnecessary or excess light. Of course, on cloudy days and at night the gas discharge lamps provide the majority if not all the illumination required within the warehouse environment. During those times that the lamps are producing unnecessary light, the lamps are also consuming unnecessary power. Ideally, the lamps could be controlled to deliver sufficient illumination, depending on the availability of natural light, while consuming minimal power.

In many cases, the consumption of energy by the gas discharge lamps is directly related to the illumination intensity level produced by the lamps. During times when the lamps produce a relatively bright illumination intensity, a relatively higher level of the energy is typically consumed by the lamp.

Setting or controlling the circuit to deliver the proper amount of power to the lamp under variable conditions has typically required the use of a manual-type control mechanism. Such a manual control mechanism may be either a slide switch or a knob. Each of these mechanisms allow for the variable control of the illumination intensity but unfortunately also require that an operator physically manipulate the devices in order to vary the illumination intensity. This type of control is unsatisfactory in conditions where the light entering through the windows is constantly varying since the operator must continuously take the time to adjust the illumination intensity in accordance with the varying light conditions. Hence on intermittently cloudy days or at dusk the operator is continuously interrupted to adjust the illumination intensity.

Moreover, implementing a manual-type control switch introduces the possibility that the person operating the switch may incorrectly determine whether the lamp is generating the proper or optimal illumination intensity for a given situation. Manually adjusted control systems are also difficult to set since many lamps may need to be adjusted to various independent levels based on the location of the windows in the building. For instance, the lamps located far from windows or skylights most likely should be adjusted to provide more illumination than those lamps located near a window or skylight. Unfortunately, the typical control switch controls many of these lamps from one location so that the operator does not have to walk to many different locations to adjust the lights. However, this location may be relatively far from some of the lamps which decreases a person's ability to accurately detect whether the illumination intensity produced by each particular lamp is satisfactory, let alone optimal. Indeed, the operator can only guess the proper illumination intensity for each of the different zones illuminated by the various lamps.

In order to overcome these drawbacks, gas discharge lamps are generally operated at higher-than-necessary intensity levels based on worst-case scenarios. For example, on intermittent cloudy days, the lamps are generally set to provide sufficient illumination based on times when the cloud cover blocks most natural light. The result is that more illumination than necessary is generated during periods of time when the clouds have dissipated which results in unnecessary energy consumption.

It is with respect to these considerations and others that the present invention has been made.

SUMMARY OF THE INVENTION

The present invention relates to a control system for controlling the lumen output of gas discharge lamps to improve energy efficiency. One aspect of the present invention is to automatically control the lumen output of the lamps with reduced reliance on a manual control. Another aspect of the present invention is to provide a control system that can be adjusted from a position within or near the area illuminated by the lamp eliminating the estimation involved in determining the proper illumination intensity. Yet another aspect of the present invention is to provide these capabilities in the form of control modules that may be added or removed from the control system as desired. Still another aspect is to provide, as part of the automatic control module, a light sensor circuit that is relatively immune to effects of time and temperature.

To accomplish these and other aspects, the present invention relates to a control system that comprises a control circuit that automatically adjusts the illumination intensity of the gas discharge lamp based on the available light from other sources, i.e., natural light. More specifically, the control system incorporates a daylight harvester that senses the amount of light in a given area and produces a control signal based on the amount of light sensed. The control signal is conducted to the control circuit which effectively adjusts the illumination intensity of the gas discharge lamp. The control system may also incorporate a remote signal receiver which senses a remote signal and based on this remote signal, conducts a control signal to the control circuit which controls the illumination intensity of the lamp. Additionally, the daylight harvester and the remote receiver are removable from the control circuit. Moreover, the daylight harvester comprises a blind sensor in combination with the light sensor and the control signal produced by the daylight sensor is a differential control signal so that adverse effects due to time and temperature do not affect the control of the illumination intensity.

More particularly, the control system of the present invention comprises a control system for controlling power consumption of a gas discharge lamp wherein the control system comprises a light sensor which senses light and produces a control signal in response to the sensed light. The control system also comprises a control circuit which is connected to the light sensor and receives the control signal from the light sensor. Additionally, the control circuit comprises a frequency controlled dimming ballast which controls the power consumption of the gas discharge lamp by adjusting the conduction of electrical power to the gas discharge lamp in response to the control signal. The frequency controlled dimming ballast comprises a high leakage based transformer that controls the conduction of current to the gas discharge lamp in response to an oscillating driving signal.

The light sensor of one embodiment of the present invention comprises at least two light sensors wherein one of the light sensors senses ambient light conditions and the other light sensor does not sense any light conditions. Each of the light sensors produces a separate voltage signal and conducts the signal to a differential amplifier which produces the control signal. Additionally, the differential amplifier further comprises a potentiometer for setting the gain of the amplifier wherein the potentiometer itself may be adjusted by a remote control signal. The control signal produced by the differential amplifier is conducted to a low pass filter stage which conditions the control signal to filter out adjustments in the control signal caused by relatively brief changes in the ambient light conditions.

In another embodiment the control system of the present invention comprises a remote signal receiver that comprises at least two light sensors and wherein one light sensor is activated to increase the illumination intensity of the gas discharge lamp and the other light sensor is activated to decrease the illumination intensity of the lamp. The light sensors are activated using a directional pointing laser device and cause a logical switch to switch on when one of the two light sensors is activated. Switching the logical switch on causes a digital counter circuit connected to the logical switch to increase or decrease a count signal. The count signal is conducted to a digital to analog converter connected to the counter circuit converts the count signal to an analog voltage control signal and conducts the control signal to the control circuit. The remote signal receiver may also be used in conjunction with the daylight harvester to provide the benefits of both devices in one embodiment.

A more complete appreciation of the present invention and its scope can be obtained by reference to the accompanying drawings, which are briefly summarized below, the following detailed description of presently preferred embodiments of the invention, and the appended claims.

DETAILED DESCRIPTION OF THE INVENTION

Figure 1:
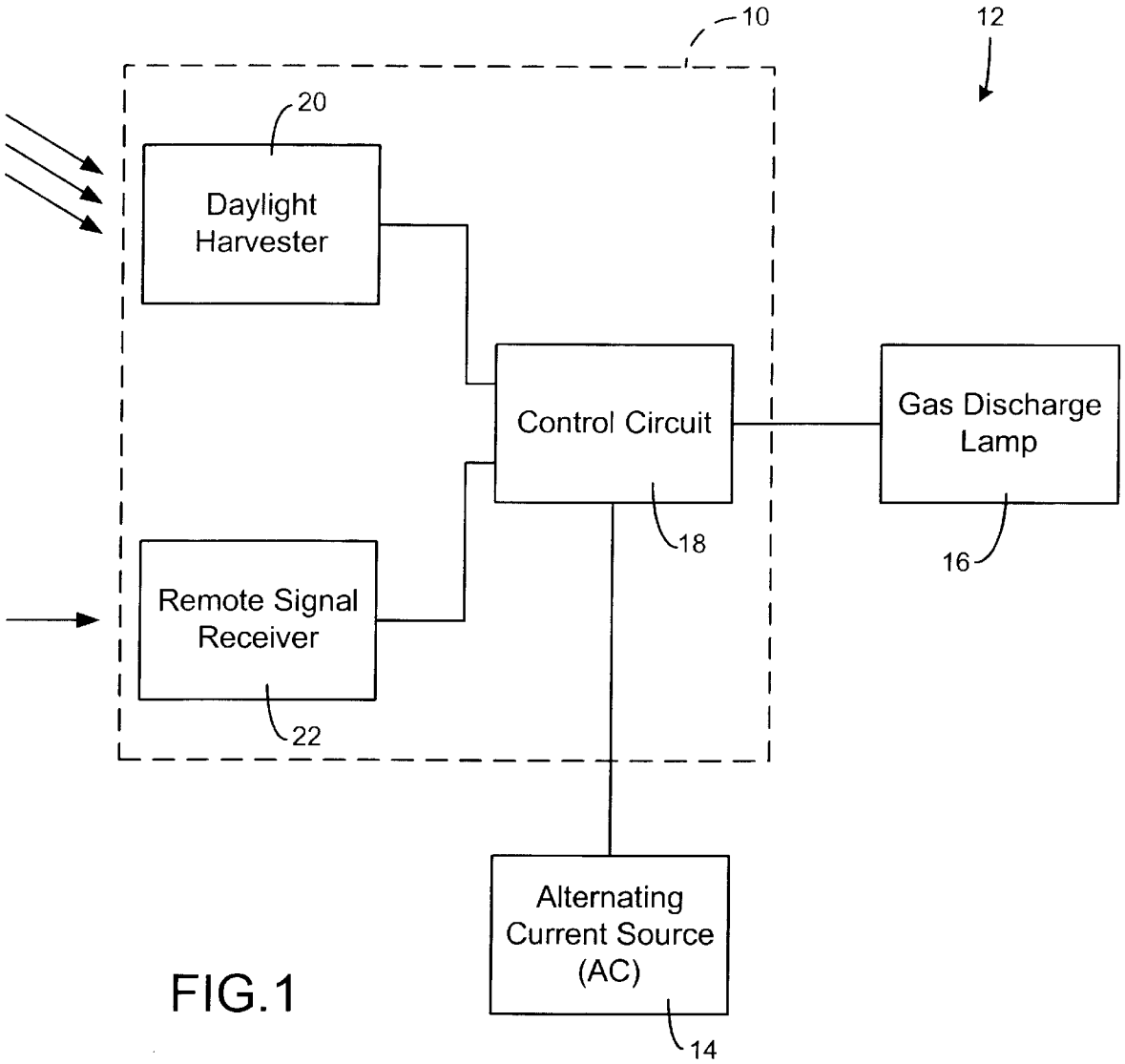
FIG. 1 is a simplified block diagram illustrating a gas discharge lamp circuit comprising a control system of the present invention which is connected to a power source and a gas discharge lamp.

The features of the present invention are preferably embodied in a control system 10 which is part of a gas discharge lamp circuit 12 as shown in FIG. 1. The control system 10 is connected to an alternating current (AC) power source 14 and a gas discharge lamp 16. The AC power source 14 is conventional and provides AC power to the control system 10 over conventional power supply conductors and to the gas discharge lamp through the control system 10. The gas discharge lamp 16 is conventional and may be either a fluorescent lamp, a metal halide lamp or another type of gas discharge lamp.

The gas discharge lamp 16 comprises a glass housing (not shown) enclosing two cathodes (not shown) located at opposite ends of the housing. The cathodes are connected to the control system 10 and, more specifically, to a control circuit 18 which initially conducts electrical current from the power source 14 through the cathodes to heat the cathodes. The control circuit 18 also comprises ignition capabilities such that, once the cathodes are sufficiently heated, the control circuit 18 generates and delivers a high voltage spike to the cathodes. The high voltage spike ignites the lamp 16, creating a plasma within the glass housing. The plasma interacts with a phosphorescent coating on the glass housing to provide illumination. The plasma also provides a relatively low resistance current path for the electrical current to propagate from one cathode to the other through the plasma, which maintains the lamp in an ignited condition.

The control system 10 comprises the control circuit 18 which effectively ignites the lamp 16 and maintains the lamp 16 ignited at varying illumination intensities. The control circuit 18 receives control signals and based on these signals, controls the actual delivery of current to the lamp 16 to vary the illumination intensity of the lamp 16. Additionally, the control system 10 also comprises either a daylight harvester 20 or a remote signal receiver 22 or both. The daylight harvester 20 is electrically connected to the control circuit 18 and senses the light intensity in a given area and produces a control signal based on the sensed information. The control signal is conducted to the control circuit 18 which then controls the illumination intensity of the lamp 16 based on the control signal.

Similarly, the remote signal receiver 22 may be connected to the control circuit 18 as shown in FIG. 1. When connected in this manner, the remote signal receiver 22 senses a remotely conducted light signal and transmits a control signal to the control circuit 18 based on the remotely conducted signal. The control circuit 18 receives the control signal and adjusts the illumination intensity of the lamp 16 in accordance with the control signal received from the remote signal receiver 22.

Figure 2:
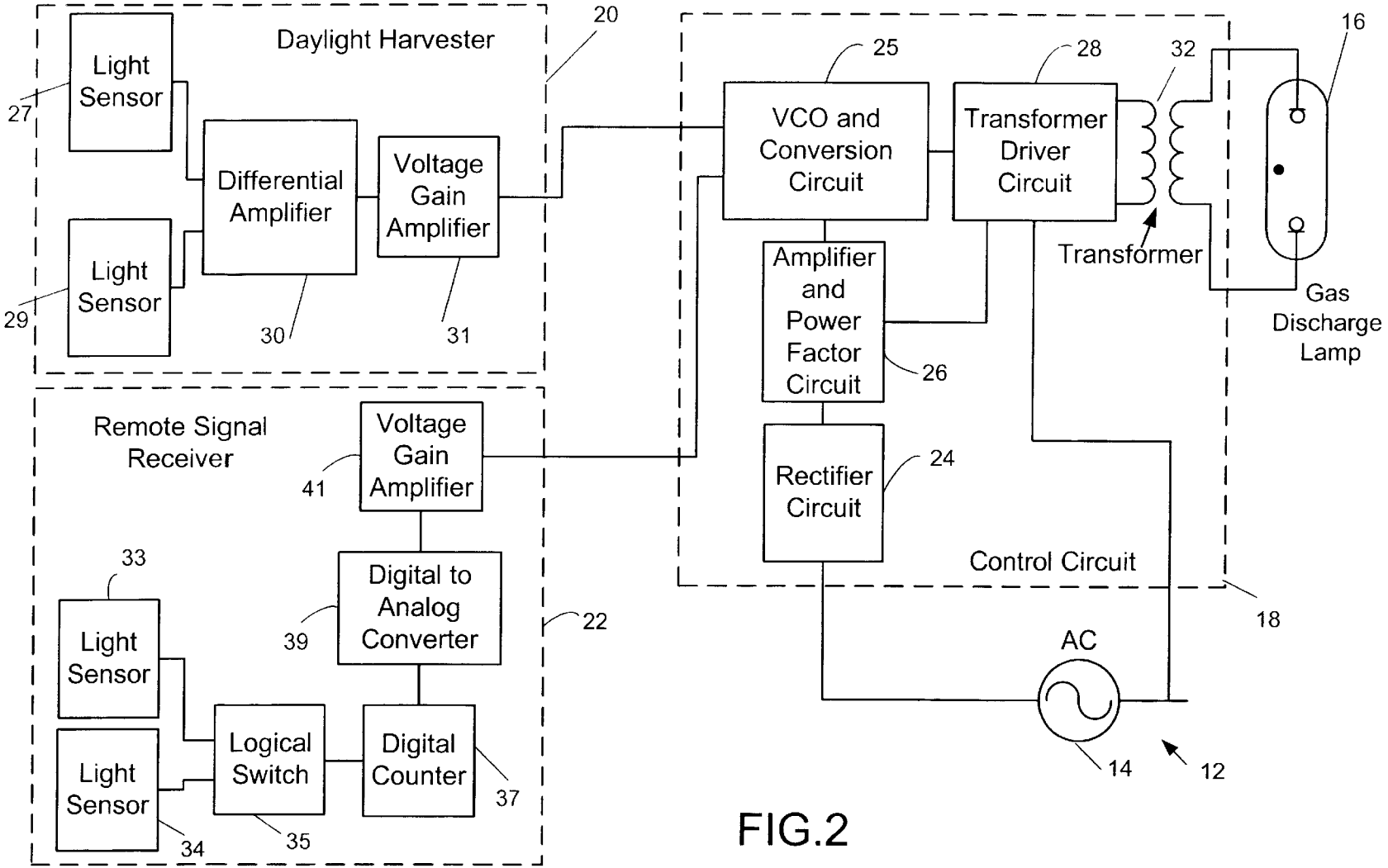
FIG. 2 is a partial block diagram and partial schematic diagram illustrating the components of a control circuit, a daylight harvester and a remote signal receiver that are part of the control system shown in FIG. 1.

The control circuit 18 comprises a voltage controlled oscillator (VCO) 23 (shown in FIG. 3) as part of a VCO and conversion circuit 25 which receives control signals from the daylight harvester 20 and the remote signal receiver 22, as shown in FIG. 2. The control signals have voltage magnitudes related to a sensed light environment or remotely conducted light signals and the VCO 23 converts these voltage signals into oscillating signals having frequencies related to the voltage magnitudes of the control signals. The oscillating signals produced by the VCO 23 do not vary according to the applied AC signal which is conducted from the power source 14 to the VCO 23 through a rectifier circuit 24 and amplifier and power factor circuit 26 since the VCO conducts a regulated oscillating voltage signal based on the applied voltage from either the daylight harvester 20 and the remote signal receiver 22.

The oscillating signals are conducted to a transformer driver circuit 28 which effectively drives a loosely coupled transformer 32. The transformer 32 generates a varying current signal, based on the frequency of the oscillating driving signal, while maintaining a relatively constant voltage across the transformer and conducts this current to the lamp 16. As the current delivered to the lamp varies, the illumination intensity of the lamp 16 also changes. The particular property of the loosely coupled transformer 32 wherein a variable current is produced from a driving signal having a variable frequency but a relatively constant voltage amplitude, i.e., using a frequency controlled dimming ballast as described in the previously cited patent applications is fundamental to controlling the illumination intensity of the gas discharge lamp without employing pulse width modulation or some other technique.

More specifically, as the voltage applied to the VCO 23 from the daylight harvester 20 or remote signal receiver 22 increases the frequency of the oscillating signal generated by the VCO 23 increases. Consequently, the resulting leakage in the transformer increases which reduces the current conduction from the transformer to the lamp which, in turn, decreases the illumination intensity of the lamp 16. Conversely, decreasing the applied voltage to the VCO 23 increases the illumination intensity of the lamp 16.

A preferred embodiment of the daylight harvester 20 comprises two similar if not identical light sensors 27 and 29, as shown in FIG. 2, although only one such sensor is required to operate the daylight harvester 20. One of the two sensors, e.g., the first sensor 27, senses the ambient light available in a given area. The light sensor 27 generates a voltage linearly related to the illumination intensity in that area. The other light sensor 29 does not sense any light, i.e., it is blind. The second light sensor 29 produces a relatively small voltage signal related to external changes in temperature and internal changes in the light sensor due to age or other environmental conditions. Since both sensors 27 and 29 are in close proximity to one another, are the same type of sensor and are the same age, the two voltage signals created by each sensor are affected by the same environmental conditions and both voltages contain an offset related to these conditions. Since the second sensor 29 is blind, the voltage signal conducted by the second sensor relates almost entirely to the offset voltage caused by these environmental conditions.

In order to account for, and minimize the adverse effect of these environmental conditions, the magnitude of the voltage signal produced by the second light sensor 29 is subtracted from the magnitude of the voltage signal produced by the first light sensor using a differential amplifier 30. The differential signal generated by the differential amplifier thus represents a voltage signal based almost entirely on the illumination intensity of a given area.

The differential signal is conducted to a voltage gain amplifier 31 to either increase or decrease the magnitude of the voltage signal so that the voltage control signal conducted to the VCO 23 is within an expected voltage range for the VCO 23. The gain amplifier 31 provides a voltage signal that is substantially linearly related to the differential signal and therefore the voltage characteristics of the control signal conducted to the VCO 23 are in accordance with the illumination intensity of the sensed environment.

Using a daylight harvester to sense ambient light conditions and produce a related control signal effectively eliminates the need for a manual-type control switch. As the amount of available light changes the sensor senses the change and adjusts its control signal accordingly. Thus the illumination intensity of the lamp 16 may be automatically maintained at a level which provides adequate light yet conserves power since no unnecessary light is produced.

The remote signal receiver 22 (FIG. 2) utilizes a first light sensor 33 that senses particular light signals conducted to the receiver 22. The light signals sensed by the first light sensor 33 cause the control circuit 18 to increase the intensity of the lamp 16. Similarly, the remote signal receiver 22 has a second light sensor 34 which senses different light signals which, when sensed, cause the control circuit 18 to decrease the illumination intensity of the lamp 16. These sensors are preferably optical transistors that switch on when a signal is sensed.

Once one of the sensors 33 or 34 turns on, a logical switch 35 that is connected to the sensors changes states. During the time period when the logical switch 35 is in a particular state, a digital counter 37 actively counts clock pulses and produces a digital count signal representing the present count. The count signal is conducted to digital to analog converter (D/A converter) 39 which produces an analog voltage signal related to the count signal. This analog signal is either linearly increased or decreased in a voltage gain amplifier 41 and conducted to the VCO 23 of the control circuit 18.

The remote signal receiver 22 allows a user to control a light from a remote location. Using a remote control, not shown, the user can remain in the area that is lighted and adjust the illumination intensity of the lamp 16 without moving from the actual lighted environment.

Details of the control circuit 18 and its functions in igniting and maintaining the lamp 16 ignited are described in detail in the co-pending U.S. patent application Ser. No. 08/982,975 titled "FREQUENCY CONTROLLED, QUICK AND SOFT START GAS DISCHARGE LAMP BALLAST AND METHOD THEREFOR," as cited above. Some of the more relevant aspects of those details are next described in conjunction with FIG. 3 as a basis for a more complete understanding of the present invention.

Figure 3:
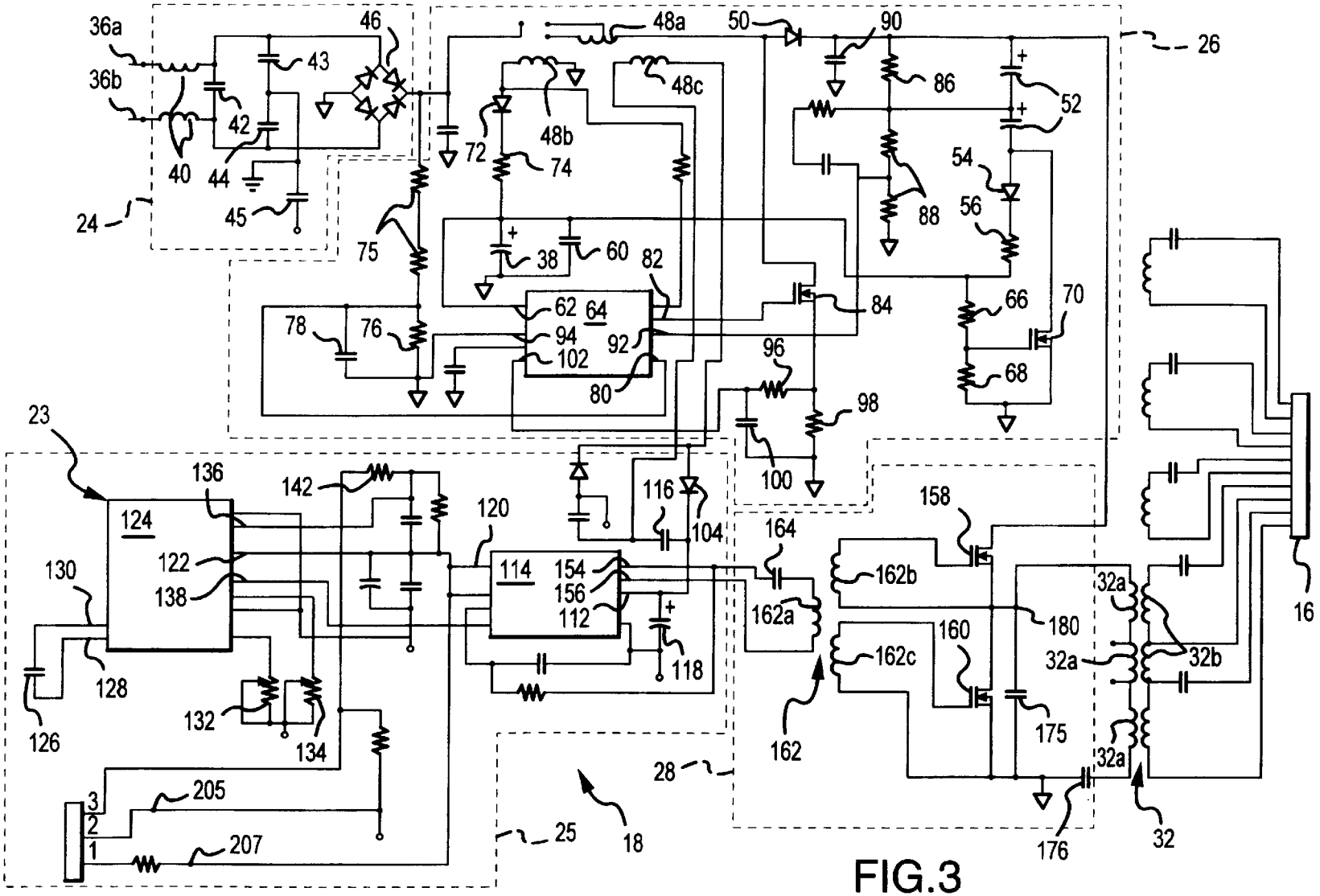
FIG. 3 is a schematic diagram of an embodiment of the control circuit shown in FIGS. 1 and 2.

FIG. 3 illustrates in greater detail the components of an embodiment of the control circuit 18 used for coupling a set of fluorescent lamps 16 to the source of electrical power 14 (FIG. 2) at terminals 36*a* and 36*b*. The general nature of the control circuit 18 is a frequency control circuit that utilizes the inherent current limiting characteristics of transformer 32 to control power to the load 16. Variations in frequency of the signal applied to transformer 32 affect the current flow through primary and secondary winding of the transformer 32 to thereby limit the electrical power to the load 16. The transformer 32 is therefore a frequency controlled ballast.

The power source 14 (FIG. 1) used in this embodiment is 110 volts AC at a frequency of 60 hertz, the standard power conditions found in the United States. The depicted control circuit 18, however, can accept input voltages in the range of 90 to 300 volts AC at frequencies of 50 to 60 hertz or 140 to 450 volts DC. This permits the control circuit 18, which acts as an electronic ballast, to function satisfactorily, in full accordance with its specifications, in any country in the world under most power conditions that will be encountered.

The rectifier circuit 24 receives an AC voltage signal having a frequency and voltage level normal for the specific location of the world at which the control system 10 is being used.

The rectifier circuit 24 comprises inductors 40 and capacitors 42 and 44 which form an Electromagnetic Interference (EMI) filter or common mode choke filter that reduces EMI conducted to terminals 36*a* and 36*b* by limiting high frequency signals and passing only signals that have a complete path through the control circuit 18. Additionally, the circuit 24 comprises a full wave rectifier bridge 46 converts the applied AC signal into a rectified voltage signal. The output voltage signal of bridge 46 passes to the circuit 26 which amplifies the received rectified voltage signal to a self-sustaining value appropriate for the lamp 16. In the circuit 26, the signal passes through several paths, one path being through boost choke 48*a* and diode 50, to provide power to output FETs 158 and 160. Another path being through diode 50, capacitors 52, resistor 56, diode 54 and capacitors 58 and 60 which are part of the boost power factor circuit 26. Capacitors 58 and 60 are connected to input pin 62 of power factor chip 64 as shown in FIG. 3.

Power factor chip 64 is a current mode power factor controller, e.g., a Motorola, MC 33262, that is designed to enhance poor power factor loads by keeping the AC line current sinusoidal and in phase with the line voltage. Resistors 66 and 68 in combination with FET 70 impose a pre-set voltage limit across capacitor 58 to limit the voltage across capacitor 58 and protect IC chip 64.

The circuit arrangement described above limits the total in-rush current at an input of 120 volts, where the voltage and current are 90 degrees out of phase with each other which is the worst case, to 4.3 amps. At the same time, the circuit insures that the appropriate voltage is applied to pin 62 of the power factor chip 64 to start it without ongoing loss of power even when the input voltage is at lowest expected value, in this case 90 volts AC.

Once appropriate power to chip 64 is provided, FET 70 is turned on as explained above, and as a result, diode 54 and resistor 56 are not part of the active circuit path and thus power is conserved. In essence, the resistor 56 is used during the first half cycle of operation to limit in-rush current and act as part of a voltage divider until FET 70 conducts and thereafter is effectively removed from the operational portion of the control circuit 18.

Once initiated, IC chip 64 is made self-supporting by forcing an inductive kick to occur in choke 48*a,* and derivatively in its secondary coil 48*b,* in phase with the haversines available at the output of full wave rectifier bridge 46 as discussed below.

The output voltage signal produced by bridge 46 is conducted to resistors 75 and 76, which form a voltage divider, and partially to capacitor 78 which helps filter voltage applied to input pin 80 of IC chip 64. The IC chip 64 then generates voltage signal which is present on pin 82 and is conducted to FET 84 and turns FET 84 on whenever the appropriate voltage level is reached during each haversine. When FET 84 turns on, it very quickly pulls one side (the right side as shown) of coil 48*a* to ground, and when it releases, causes the inductive kick in coil 48*a* and the reflective inductive kick in coil 48*b,* both of which are in phase with the haversines derived from the input power line. The induced voltage level is determined by the voltage divider formed by resistors 86 and 88. In this application, the values of resistors 86 and 88 are selected to produce a total value of 450 volts on capacitor 52. The total voltage is the result of the output voltage signal conducted by the bridge 46 and the voltage resulting from the inductive kick in coil 48 for the time period that FET 84 is turned off. The 450 volts charge capacitors 52 and 90 to that level in phase with the input line voltage, or nearly so with the variance being approximately one degree out of phase. Capacitor 90 also serves as a high frequency filter.

Feedback from the junction of resistors 86 and 88 is provided to input pin 92 of IC chip 64 as a reference voltage to the internal circuitry of IC chip 64 indicating that the correct DC voltage has been reached. The drive voltage is then removed from pin 82 and FET 84 turns off until the occurrence of the next haversine.

Since capacitor 52 may be discharged when the control circuit 18 is loaded, the resultant 450 volts is also used via feedback to keep IC chip 64 powered on as well as to provide power to the remainder of the circuit 18 and to the lamps 16. Feedback power to IC chip 64 is provided by coil 48*b,* through diode 72 and resistor 74 to capacitors 58 and 60. Capacitor 58 applies power to input pin 94 of IC 64 as previously described through the voltage limiting combination of resistors 66 and 68 and FET 70. Diode 72 and resistor 74 are inserted in the path from coil 48*b* to capacitors 58 and 60. Diode 72 serves to prevent discharge from capacitors 58 of 60 from causing unwanted current flow into coil 48*b* while resistor 74 serves to limit current in that circuit leg to capacitors 58 and 60 and acts as a filter in conjunction with capacitors 58 and 60 for pin 94.

The combination of resistors 96 and 98 and capacitor 100 serve to protect FET 84 by limiting and filtering the current signal drawn when FET 84 turns on. Drive voltage is supplied to output pin 102 and resistor 98 serves to limit that to a current value that can easily be tolerated by FET 84. In addition, the voltage drop across resistor 98 determines the level at which FET 84 is turned off since it provides a delay that results from its RC combination effect with capacitor 100. In addition, resistor 36 and capacitor 100 provide a high frequency filter capability for current flowing to pin 102.

Power is conducted to VCO and conversion circuit 25 by way of transformer 48. Current flowing through coil 48*a* of transformer 48 causes current to flow in secondary coil 48*c*. When coil 48*a* experiences the previously described inductive kick, a like and proportional increase in current flow is experienced in coil 48*c*. By selecting an appropriate turns ratio between coils 48*a* and 48*c,* the induced voltage in coil 48*c* can be set to any desired level. The voltage is preferably set between 14 volts and 40 volts DC. As indicated by the dots in FIG. 3 alongside coil 48*a,* 48*b* and 48*c,* their phases are chosen accordingly.

The power for the conversion circuit 25 is thus derived from coil 48*c* and passes through diode 104 to input pin 112 of integrated circuit chip 114, preferably a Texas Instruments TPS2813 multi-function chip. The voltage signal conducted to pin 112 is filtered to remove relatively-high frequency components by capacitors 116 and 118. Input pin 112 serves as the input to an internal voltage regulator (not shown) in IC chip 114. The signal produced by the regulator in IC chip 114 appears on terminal 120 of IC chip 114 and preferably has a relatively constant voltage magnitude or approximately 11.5 volts during those times when the voltage signal received on pin 112 from the coil 48*c* is between 14 and 40 volts. Output terminal 120 is electrically connected to the voltage controlled oscillator 23 such that a relatively constant voltage is conducted to the VCO 23. This voltage signal provides power to the VCO 23.

The voltage controlled oscillator 23 preferably comprises a phase-locked loop integrated circuit such as the Fairchild CD4046 shown as IC chip 124 in FIG. 3. Control of IC chip 124 is based on the capacitive value of capacitor 126 which is connected across pins 128 and 130 of IC chip 124 and the values of resistors 132 and 134. The lower frequency operating limit of IC chip 124 while the value of resistor 134 determines its upper frequency limit. The voltage signal appearing on input pin 136 sets the operating frequency of the output voltage, a DC square wave, on pin 138 of IC chip 124. Ideally, if the voltage on pin 136 is zero volts, the output on pin 138 oscillates at its lowest frequency as determined by resistor 132. If the voltage on pin 136 reaches it highest value, then the output on pin 138 of chip 124 oscillates at its highest possible frequency as set by resistor 134. Thus, the values of capacitor 126 and resistors 132 and 134 contribute to setting the frequency range of the voltage signal produced by chip 124. I.e., for a minimum and maximum voltage signal input, the chip produces an oscillating signal of a minimum and a maximum frequency, respectively. Additionally, the chip 124 preferably produces an oscillating signal that varies linearly with a variable input voltage signal.

As discussed in more detail below, a control signal produced by the daylight harvester 20 is conducted through resistor 142 and to input pin 136 of chip 124 thereby changing the voltage on pin 136 and the operating frequency of the voltage on output pin 138. This will cause a change in the current applied to and the brightness, or illumination intensity, of the lamps 16.

The multi-function IC chip 114 receives the square wave voltage signal from the chip 124, this signal having the characteristic frequency representative of the desired illumination intensity. Upon receiving the oscillating voltage signal the chip 114 produces two oscillating voltage signals, each having substantially the same frequency and substantially the same rms voltage. Each signal is substantially 180 degrees out of phase with respect to the other signal and, moreover, the rms voltage of each signal is between 10 and 13 volts independent of the magnitude of the voltage signal received from the chip 124.

Chip 114 comprises two drivers which place the two output voltage signals on the pins 154 and 156 of chip 114 which are conducted to the primary winding 162*a* of pulse transformer 162 of the transformer driver circuit 28 as shown in FIG. 3. Conducting two signals has the effect of doubling the voltage across the primary winding 162*a* of pulse transformer 162.

The outputs from driver pins 154 and 156 are a set of very closely matched square waves whose edges are within 40 nanoseconds of each other with high pulsed drive (2 amp) capacity. The AC coupling effect of capacitor 164 permits the low impedance primary inductor 162*a* to be effectively connected to output pins 154 and 156. With this output, the control circuit will drive the primary side of closely coupled pulse transformer 162*a,* the signal amplitude of which is effectively doubled at secondary transformer windings 162*b* and 162*c* to plus and minus 11 volts by the phase output from pins 154 and 156. This effectively puts a 22 volt square wave across primary 162*a*. On the secondary side of transformer 162, this means that power FET 158 will have plus 11 volts applied across its gate and source while power FET 160 will have minus 11 volts applied across its gate and source. Since the FETs are selected with optimized values of minimal on-resistance when gate to source voltage is greater than plus 5 volts and off-resistance is maximal when gate to source voltage is less than minus 5 volts, they are each turned on and off very quickly by the plus and minus 11 volts applied across their respective gate and source by the secondary windings 162*b* and 162*c* respectively. The power FETs 158 and 160 are thus turned on and off very quickly which minimizes transition losses.

The secondary windings 162*b* and 162*c* are out of phase with each other by 180 degrees such that the gate to source voltages generated therein that turn the power FETs on and off are also out of phase by approximately 180 degrees to thus prevent both FETs from being on at the same time. However, the edges of the voltage signals conducted to the FETs are so sharp and fast that there is a possibility that the FETs could be on at the same time, even if briefly. Accordingly, a slight delay is produced by the chip 114 between pulses of the square waves thereby establishing a safe zone and insuring that the power FETs 158 and 160 are not on at the same time.

The center point 180 of the power FETs 158 and 160 is connected to the primary side 32*a* of a unique transformer 32 that will be described hereinafter in greater detail. The on-off action of power FETs 158 and 160 drives point 180 between 450 volts and ground. Capacitor 176 provides AC coupling for primary winding 32*a*. Capacitor 176, which is connected to ground, charges to the middle of the voltage swing at mode 180 or to approximately 225 volts. This effectively causes an AC voltage to be impressed on primary winding 32*a* that varies between 0 to 225 to 450 volts. Capacitor 175 is a high frequency filter that removes high frequency components of the driving signal.

In response to the driving signal, current is induced in the secondary windings 32*b* of transformer 32. This current is conducted through the lamp cathodes to maintain the lamp conducting. The parameters of transformer 32 are selected to accommodate several performance factors including the power to be delivered to efficiently drive lamps 16, the open circuit voltage required to initially turn on lamps 16 and the lamp current crest factor (the ratio of peak lamp current to the rms lamp current) which should be kept below 1.7.

The transformer 32 is therefore a frequency controlled dimming ballast that is a part of the control circuit 18. In addition, short circuit isolation is provided by the transformer 32 which isolates the load from the ultimate source of power and limits short circuit current to a small fraction of what it would otherwise be.

Control of the illumination intensity and thus the power consumption of lamp 16 is obtained by varying the voltage to input terminal 136 of the voltage controlled oscillator chip 124 to produce an output drive voltage of essentially constant amplitude and variable frequency. The net effect is that the current induced in the secondary side of transformer 32 is directly dependent on the frequency of the square wave produced by chip 124. The use of such an arrangement controls current as a function of frequency while maintaining the same voltage, at the secondary winding and negates any need to employ pulse width modulation and its associated resonate circuit to clean up the voltage ripple. The present electronic ballast obviates that need while providing smoother, more efficient operating conditions.

Figure 4:
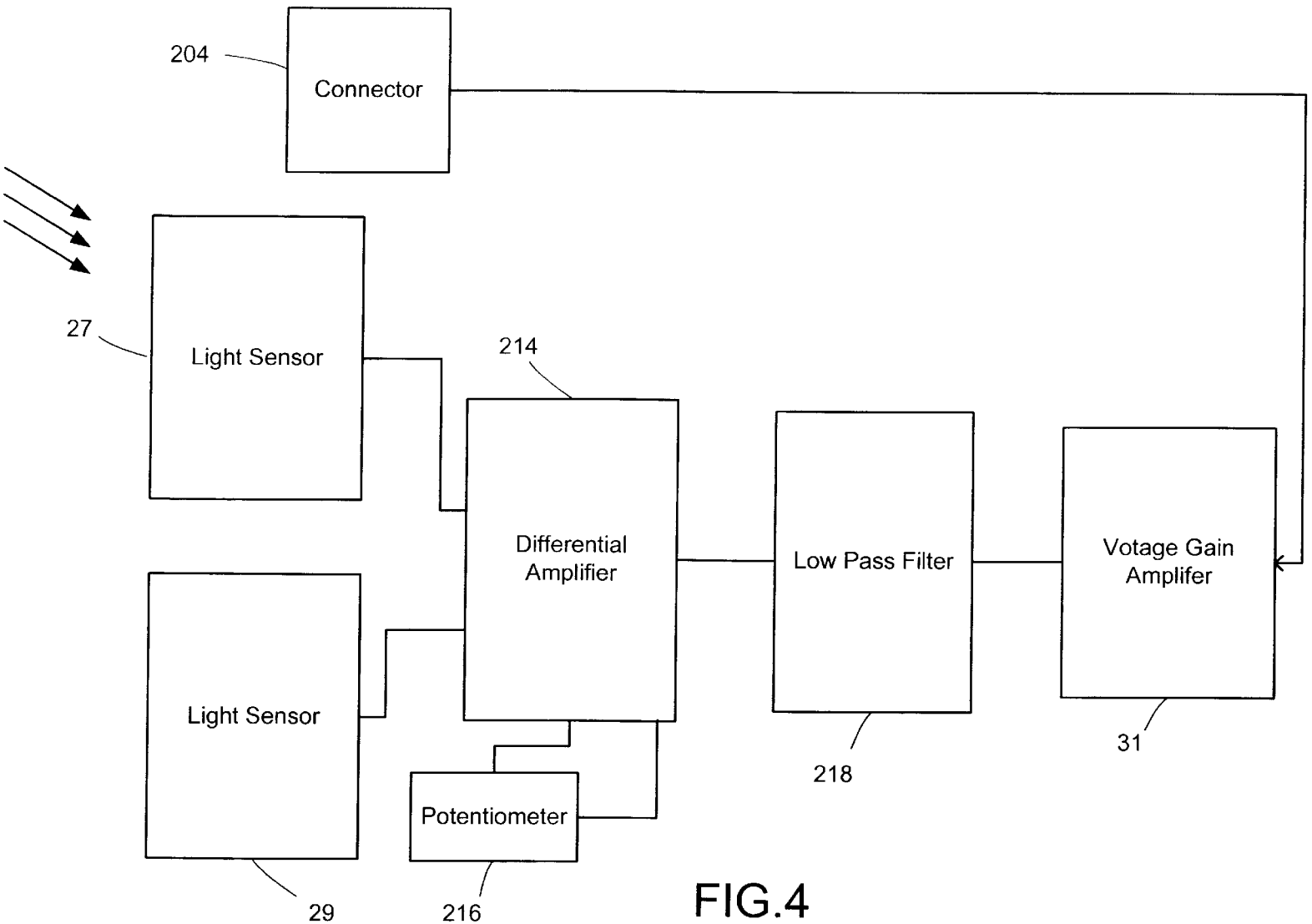
FIG. 4 is a block diagram of an embodiment of the daylight harvester shown in FIG. 2.

The daylight harvester 20 in accordance with the present invention is shown in more detail in FIG. 4. Preferably the harvester 20 is in the form of a removable module and comprises two light sensors 27 and 29. One of the light sensors 27 is used to sense the available light and conduct a voltage signal based on the sensed information to the VCO 23 shown in FIG. 3. The remaining light sensor 29 is used as a control or reference sensor to account for variations in operating conditions due to time, i.e., age of the sensor 29, and temperature, and other environmental conditions that may affect the generated signal produced by the sensors 27 and 29.

As the harvester 20 is in the form of a removable module, it has a connector 204. The preferred connector 204 is a three-terminal Molex connector which is removably connectable to a similar connector (not shown) which is electrically connected to the control circuit 18. One of the three terminals of the connector 204 connects to a power terminal (not shown) while another connects to signal ground terminal (not shown), the control circuit 18 (FIG. 3) to thus provide power and ground to the harvester 20. The third terminal 201 of the connector 204 is used as a means to conduct the control signal produced by the harvester 20 to the VCO 23.

In operation the sensor 27 senses the amount of light available in a particular zone. Preferably, the sensor 27 is a TLS254 which actually senses the illumination intensity of a particular area or zone, such as on a particular work bench. The illumination intensity in a zone is a combination of natural light and any lamps supplying light to the particular zone. The sensed illumination intensity causes the sensor 27 to produce a voltage signal that is conducted to a differential amplifier 214.

Simultaneously, the sensor 29 conducts a voltage signal to the differential amplifier. However, the sensor 29 is "blind" such that it does not sense the illumination intensity in a particular region. Although the sensor 29 is blind to light conditions, the sensor 29 is responsive to other environmental conditions, i.e., those environmental conditions other than light that impact the generated voltage signal of the both sensors 27 and 29. In essence, the sensor 29 is used to determine the accuracy of the signal produced by the sensor 27. Conducting both sensor signals to the differential amplifier 214 produces a differential signal which accurately relates to the illumination intensity of a given area.

The differential amplifier 214 also amplifies the differential signal. Typically, the voltage signals conducted from the sensors 27 and 29 are between 0 and 0.25 volts. Thus, the amplifier 214 is used to amplify the signal to a range of 0 to 10 volts. The amplifier 214 preferably has a gain on the order of 33 wherein the gain value is adjusted by the potentiometer 216. Increasing the magnitude of the differential signal in this manner provides for better control of the conducted control signal to the VCO 23, provides a control signal in the voltage range expected by the VCO 23 and may reduce errors in conducting the signal due to line propagation losses. The potentiometer 216 is adjustable by a manual control that can be placed near the sensor and/or near the area illuminated. Although this potentiometer may be set by the manufacturer, it is preferably accessible by the user to accommodate varying conditions. Moreover, this potentiometer may be set by other remote or automatic control signals if desired.

The differential signal produced by the amplifier 214 is conducted to a unity gain low pass filter 218. The low pass filter 218 comprises a differential amplifier (not shown) with a feedback capacitor (not shown). Preferably the low pass filter 218 is set at 0.2 hertz to therefore filter out transients of relatively short duration within the field of view of the light sensor 27. The filter 218 effectively conditions the control signal so that brief changes in the illumination intensity do not effect the control signal conducted by the harvester 20. For example, someone passing in front of a window briefly will most likely not cause a change in the control signal conducted to the control circuit 18. This filter also dampens the system to stabilize the output and avoid oscillations in illumination intensity.

The output of the low pass filter 218 is conducted to the output voltage gain amplifier 31. The voltage gain amplifier 31 adjusts the signal from the low pass filter 218 to produce an output control signal between 0 and 10 volts, which is representative of the illumination level on the surface or space that the light sensor 27 senses. The amplifier 31 conducts the control signal to the third terminal 201, i.e., the output terminal of the connector 204, thereby effectively conducting the control signal to the VCO 23 (FIG. 3). As stated the VCO 34 receives this control signal and adjusts the illumination intensity of the lamp 16 accordingly. Thus, when the sensor 27 senses too little illumination, the lamp intensity increases. Similarly, when the sensor 27 senses too much illumination intensity, the lamp intensity decreases. In this configuration, the lamp intensity is constantly controlled by the sensor 27.

In another embodiment of the present invention, the daylight harvester 20 is replaced with the remotely operable signal receiver 22 (FIG. 1) and operates as a dimmer control module. As in the first embodiment, this embodiment comprises a removable module having a connector 256 adapted to be connected into a corresponding control connector of the control circuit 18. The remotely operable dimmer control module 22 is shown in more detail in FIG. 5.

Figure 5:
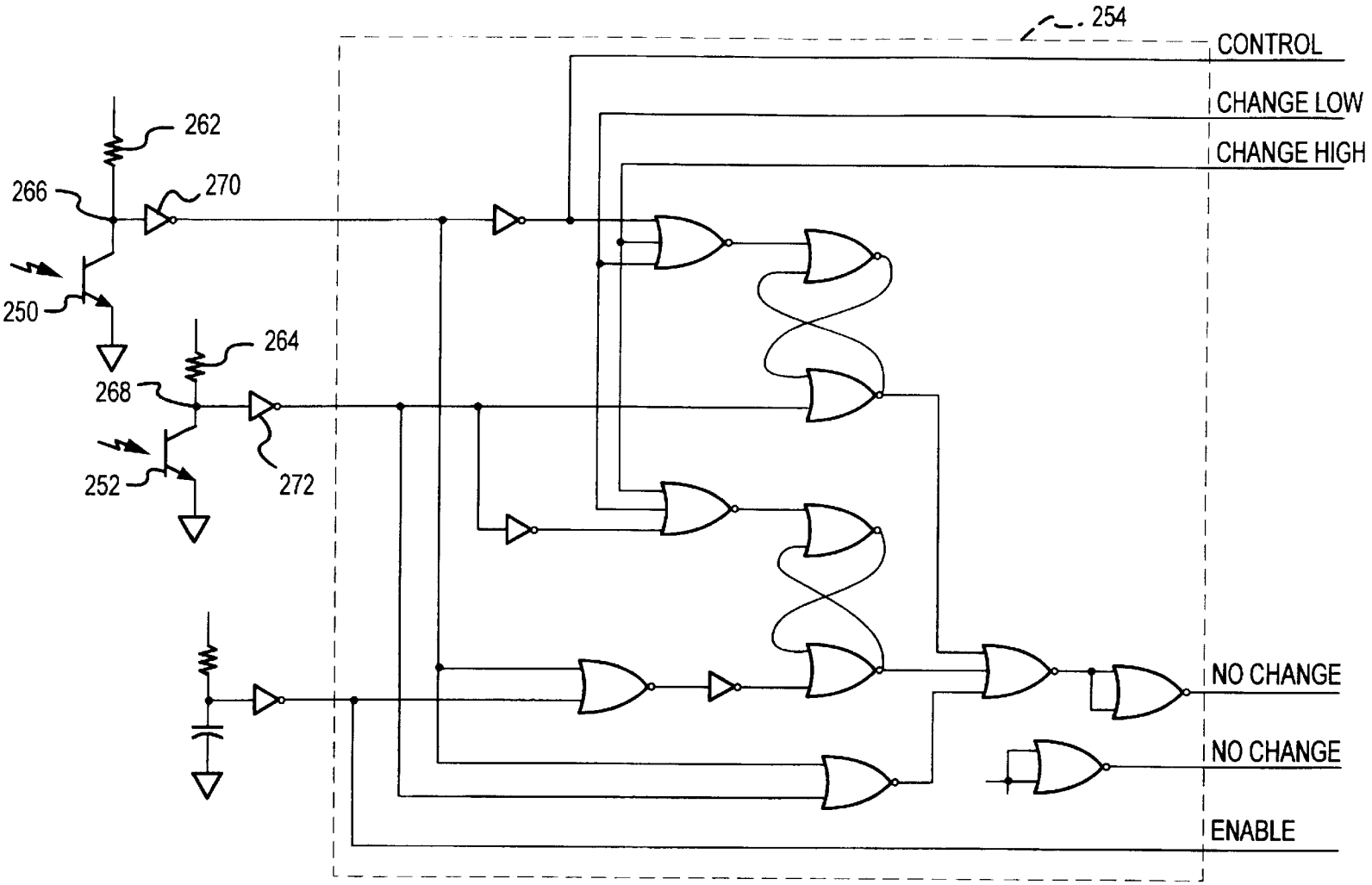
FIG. 5 is a schematic diagram of portions of the remote signal receiver shown in FIG. 2.
Figure 6:
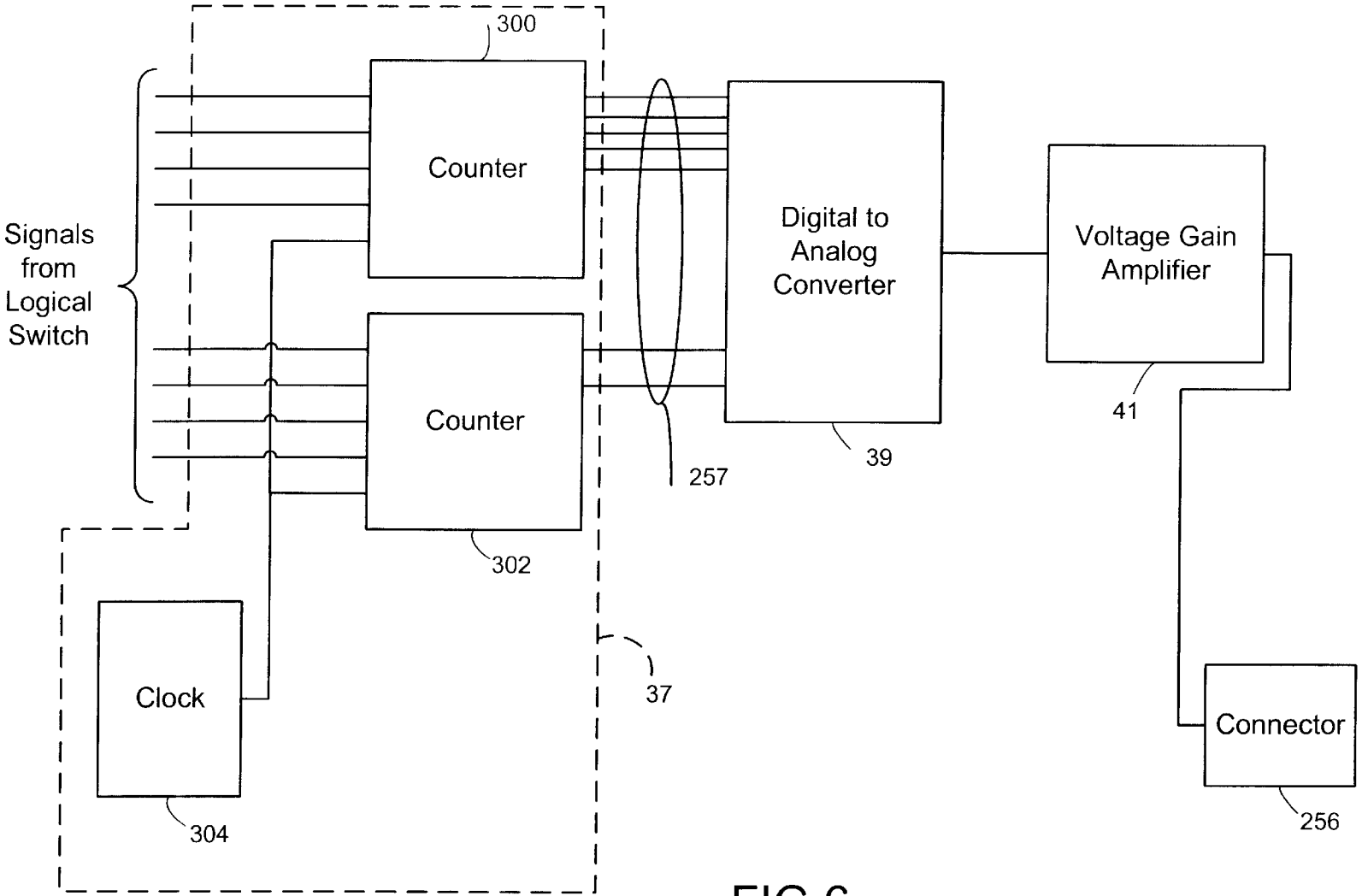
FIG. 6 is a block diagram of remaining portions of the remote signal receiver shown in FIG. 2.

The remote receiver 22 comprises two light sensors 33 and 34 (FIG. 2) in the form of two photo sensitive transistors 250 and 252, as shown in FIG. 5. The transistors 250 and 252 are electrically connected to a multi-level switching circuit 254 which is an embodiment of the logical switch 35 (FIG. 2). The circuit 254 is connected to and conducts a digital start signal to a digital counter circuit 37 (FIG. 6). The counter circuit 37 receives the start signal and begins a "counting" process where the circuit 37 produces a binary coded reference signal having six bits on six conductors 257, the signal incrementally increases over time until either the circuit 254 conducts a digital stop signal or the maximum number is reached. The six bit signal created by the counting circuit 37 represents the desired illumination level of the lamps 16. The digitally coded signal is then conducted to a digital to analog (D/A) converter 39 which converts the signal to a control signal and conducts the control signal to the voltage gain amplifier 41. The gain amplifier 41 adjusts the voltage signal produced by the D/A converter to a level appropriate for the VCO 23 (FIG. 2). The voltage gain amplifier 41 conducts the adjusted voltage signal to a connector 256 which effectively conducts the voltage signal to the VCO 23. As discussed above, the VCO 23 receives the voltage signal and adjusts the frequency of its output signal to adjust the illumination intensity of the lamps 16.

The details of the remote signal receiver 22 are understood from the schematic and block diagram shown in FIGS. 5 and 6. Photo transistors 250 and 252 receive power through resistors 262 and 264 respectively, at nodes 266 and 268 respectively. Inverter 270 also connects to transistor 250 at node 266. Initially, the digital value present at node 266 is zero and the value remains zero until the transistor 250 has been activated by a light. Similarly inverter 272 connects to the transistor 252 at node 268 and the initial digital value at node 268 is zero, until transistor 252 is activated. Preferably, laser light or infrared light is used to activate the transistors 250 and 252. Additionally, when transistor 250 is selectively activated, the lamps 16 decrease their illumination intensity and when transistor 252 is activated, the lamps 16 increase their illumination intensity, as discussed below. The photo transistors 250 and 252 are activated by directing a fine ray of light, such as a laser, on only one transistor at a time.

When transistor 250 is activated and the logical value at node 266 changes, the change causing logical switch 254 to change states, e.g., switching the logical switch 254 on. The logical switch incorporates numerous logic gates to enable signals that are conducted to the counters 300 and 302. This switch buffers the signals and conducts a no change signal to the counters so that they do not count when the photo transistors are not activated.

When the logical switch 254 switches on, up/down counters 300 and 302 of the counting circuit 256 start counting pulses received from a free running clock 304. The free running clock 304 continuously conducts pulses to the counters 300 and 302. The clock 304 is preferably set so that approximately 64 pulses are delivered to the counters 300 and 302 every five seconds. Thus, the counters are able to count from 0 to 63 in approximately five seconds. Since the coded signal is a six-bit digitally coded signal, there are 64 different possibilities. Thus, the counter circuit 246 is able to achieve all possibilities in approximately five seconds. If desired, the rate at which pulses are conducted to the counters 300 and 302 can be adjusted to modify the time required to achieve all possible coded signals. However, some delay is necessary to allow the user some reaction time between activating the control circuit and witnessing the resulting illumination intensity. Five seconds is the preferable amount of time, which allows for some reaction time.

Essentially, the counters produce digital signals conducted on six separate electrical conductors 257. Each conductor conducts either a logical high signal, which may be approximately 5 or more volts, or a logical low signal which is approximately zero volts. These conductors may be represented as a binary number having a least significant bit, a most significant bit and various bits in between. The conductors are electrically connected to the D/A converter 39 as depicted in FIG. 6. The D/A converter 39 is an otherwise typical D/A converter modified to convert a six bit coded signal into a DC control voltage signal between 0–10 volts. The resulting signal of the D/A converter 39 may be any one of approximately 64 incremental values based on the coded signal received from the counter circuit 37.

As stated, the control voltage produced by the D/A converter 39 is conducted to the gain amplifier 41 where it is linearly adjusted to appropriate levels. The signal produced by the gain amplifier 41 is then conducted to the third terminal of the Molex connector 256 and is thus effectively conducted to the VCO 23 (FIG. 3) to adjust the light level of the lamp 16.

In operation, when the control system 10 is initially turned on, the counters 300 and 302 are preferably set or reset to a predetermined digital combination to a predetermined initial light level, e.g., maximum illumination intensity. The counter 37 produces a coded signal representative of the desired initial lamp level and conducts the signal to the D/A converter 39. The D/A converter conducts the converted signal, i.e., the control voltage signal to chip 124 of the VCO 23 which then produces an oscillating signal based on the control voltage signal. The oscillating signal controls the amount of current conducted to the lamps 16, and hence the illumination intensity of the lamps 16. The user then points a light such as a laser light at the photo-transistor 250, causing it to conduct which switches the logical switch 254 turns on. The counters 300 and 302 begin accumulating pulses from the clock 304 which changes the coded signal being delivered to the D/A converter 39 and thus changes the illumination intensity of the lamps 16.

When the user then turns off the remote light source, the logical switch 254 turns off, conducting either a stop signal or removing an enable signal to effectively stop the counters 300 and 302. Once the counters 300 and 302 stop counting the coded signal becomes relatively constant, which causes the resulting output control signal from the D/A converter 39 to become relatively constant and thus the lamps 16 do not change their illumination intensity.

Similarly, the photo-transistor 252 can be used to switch on or off the logical circuit 254. However, when the switch 254 is turned on by the transistor 252, a different digital control signal is conducted to the counters 300 and 302 on a separate conductor causing the counters 300 and 302 to count down, as opposed to counting up when transistor 250 is activated. When the counters 300 and 302 count down, the coded signal "decreases" which causes the voltage signal produced by the D/A converter 258 to decrease. As the voltage conducted by the D/A converter 258 decreases the lamp intensity increases. Other than the increasing the lamp illumination intensity, the module 22 operates in substantially the same way as when the transistor 250 is activated.

While there have been described above the principles of the present invention in conjunction with specific embodiments, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. For example, the powered light fixture may be other than a fluorescent light. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention.

What is claimed is:

1. A control system for controlling power consumption of a gas discharge lamp said system comprising:

a light sensing system, which senses light and produces a control signal in response to the sensed light;

a control circuit connected to the light sensor to receive the control signal; and wherein the control circuit comprises a frequency controlled dimming ballast, the ballast having a loosely coupled transformer which controls the power consumption of the gas discharge lamp by adjusting the conduction of electrical current to the gas discharge lamp in response to the control signal.

2. A control system as defined in claim 1 wherein the light sensing system comprises a daylight harvester that senses ambient light conditions.

3. A control system as defined in claim 2 wherein the daylight harvester further comprises:

at least two light sensors;

one of the light sensors senses ambient light conditions;

the other light sensor is blind to light conditions and responsive to other environmental conditions;

each of the light sensors produces a separate voltage signal and conducts the signal to a differential amplifier; and the differential amplifier receives the voltage signals from the light sensors and produces the control signal in response to these voltage signals.

4. A control system as defined in claim 3 wherein the differential amplifier stage further comprises a potentiometer for setting the gain associated with the differential amplifier.

5. A control system as defined in claim 4 wherein the potentiometer is adjusted by a remote control signal.

6. A control system as defined in claim 3 wherein the control signal produced by the differential amplifier is conducted to a low pass filter stage;

wherein the low pass filter stage conditions the control signal to filter out adjustments in the control signal caused by relatively brief changes in the ambient light conditions.

7. A control system as defined in claim 2 wherein the daylight harvester is adapted to be removable from the control system.

8. A control system as defined in claim 1 wherein the light sensing system comprises a remote signal receiver.

9. A control system as defined in claim 8 wherein the remote signal receiver further comprises:

at least two light sensors wherein one light sensor is activated to increase the illumination intensity of the gas discharge lamp; and the other light sensor is activated to decrease the illumination intensity of the lamp.

10. A control system for controlling power consumption of a gas discharge lamp, said system comprising:

a light sensing system having a remote signal receiver wherein the remote signal receiver has a plurality of light sensors that sense light, the remote signal receiver produces a control signal in response to the sensed light, and wherein the light sensors are activated using a directional pointing laser device;

control circuit connected to the light sensing system to receive the control signal; and wherein the control circuit comprises a frequency controlled dimming ballast, the ballast controls the power consumption of the gas discharge lamp by adjusting the conduction of electrical power to the gas discharge lamp in response to the control signal.

11. A control system as defined in claim 10 wherein the remote signal receiver further comprises;

a logical switch that switches on when one of the two light sensors is activated;

a digital counter circuit connected to the logical switch that increases or decreases a count signal when the logical switch is activated;

a digital to analog converter connected to the counter circuit and adapted to receive the count signal and convert the count signal to an analog voltage control signal and conduct the control signal to the control circuit.

12. A lamp circuit comprising:

a gas discharge lamp;

a frequency controlled ballast comprising a loosely coupled transformer adapted to control the conduction of power to the gas discharge lamp to adjust illumination intensity of the lamp;

a daylight harvester connected to the ballast to produce a control signal based on sensed conditions; and a voltage controlled oscillator that receives the control signal from the daylight harvester and produces a driving signal having a frequency dependent on the received control signal; and wherein the ballast adjusts the illumination intensity of the lamp based on the driving signal.

13. A lamp circuit as defined in claim 12 wherein the circuit further comprises:

a remote signal receiver connected to the voltage controlled oscillator to produce a second control signal in response to sensed light signals and conduct the second control signal to the voltage controlled oscillator; and wherein the voltage controlled oscillator adjusts the illumination intensity of the lamp based on the second control signal.

14. A control system for controlling the illumination intensity of a gas discharge lamp connected to a control circuit having a frequency controlled dimming ballast, wherein the ballast further comprises a loosely coupled transformer, said system comprising:

a light sensing system which senses ambient light conditions and produces a control signal in response to the ambient light conditions; and the control circuit receiving the control signal;

wherein the control circuit connected to the gas discharge lamp and adapted to control the illumination intensity of the gas discharge lamp in response to the control signal, the control circuit converting the control signal into an oscillating signal having a control frequency and wherein the control frequency determines the illumination intensity of the gas discharge lamp.

15. The control system as defined in claim 14 wherein the light sensing system further comprises:

a first light sensor for sensing ambient light conditions;

a second light sensor that is blind;

a differential amplifier adapted to receive voltage signals produced by each of the two light sensors;

the differential amplifier producing a differential voltage signal related to the difference between the voltage signals produced by each of the two light sensors;

a voltage gain amplifier adapted to adjust the voltage level of the differential amplifier; and the voltage gain amplifier producing said control signal and conducting said control signal to the control circuit.

16. A control system as defined in claim 14 wherein the control circuit further comprises:

a rectifier circuit adapted to receive alternating current from an alternating current source;

an amplifier and power factor circuit connected to the rectifier circuit and adapted to receive a rectified signal from the rectifier circuit;

a voltage controlled oscillator adapted to produce the oscillating signal having a frequency in response to the rectified signal and the control signal received from the light sensing system;

a conversion circuit connected to the voltage control oscillator to receive the oscillating signal from the voltage control oscillator and adapted to produce closely matched square waves in response to the oscillating signal;

a transformer driver circuit adapted to receive the matched square waves from the conversion circuit;

a loosely coupled transformer adapted to receive a driving signal from the transformer driver circuit;

the transformer producing a varied frequency signal and conducting said varied frequency signal to the gas discharge lamp in response to the driving signal.

17. A control system as defined in claim 14 wherein the light sensing system comprises a remote signal receiver.

18. A control system as defined in claim 17 wherein the remote signal receiver comprises a plurality of light sensors wherein:

at least one light sensor receives light signals and produces a control signal directing the control circuit to increase the illumination intensity of the lamp; and the other light sensor senses light signals in response to remotely conducted light signals and produces a control signal directing the control circuit to decrease the illumination intensity of the lamp.

19. A control system as defined in claim 18 wherein the light sensors are optical transistors that turn on when a light signal is sensed.

20. A control system for controlling the illumination intensity of a gas discharge lamp, said system comprising:

a light sensing system comprising a remote signal receiver having a plurality of light sensors, the remote signal receiver further comprising:

a logical switch connected to the light sensors, wherein the logical switch changes states when at least one of the light sensors is turned on;

a digital counter;

a clock that produces digital pulses and conducts these pulses to the digital counter;

the digital counter adapted to count digital pulses from the clock when the logical switch is in a predetermined state and produce a digital count signal;

a digital to analog converter connected to the digital counter and adapted to produce an analog voltage control signal in response to the received digital count signal;

a control circuit adapted to receive the analog voltage control signal, wherein the control circuit is connected to the gas discharge lamp and adapted to vary the illumination intensity of the gas discharge lamp in response to the control signal.

21. A method of controlling power consumption in a gas discharge lamp, the method comprising:

sensing light and producing a control signal in response to the sensed light;

producing an oscillating signal having a frequency related to the sensed light;

conducting the oscillating signal to a frequency controlled dimming ballast having a loosely coupled transformer; and wherein the frequency controlled dimming ballast conducts a predetermined current signal to the gas discharge lamp in response to the oscillating signal, the predetermined current signal having a magnitude related to the frequency of the oscillating signal.

22. A method of controlling power consumption in a discharge lamp as defined in claim 21 wherein the act of sensing light senses ambient light conditions and wherein the method further comprises:

sensing at least one environmental conditions other than light; and producing the control signal in response to the sensed ambient light conditions and the at least one environmental condition.

* * * * *